US006599171B2

(12) United States Patent
Mizuno

(10) Patent No.: US 6,599,171 B2
(45) Date of Patent: Jul. 29, 2003

(54) CUP ATTACHING APPARATUS

(75) Inventor: Toshiaki Mizuno, Gamagori (JP)

(73) Assignee: Nidek Co., Ltd., Aichi (JP)

( * ) Notice: Subject to any disclaimer, the term of this patent is extended or adjusted under 35 U.S.C. 154(b) by 260 days.

(21) Appl. No.: 09/842,626

(22) Filed: Apr. 27, 2001

(65) Prior Publication Data

US 2001/0035937 A1 Nov. 1, 2001

(30) Foreign Application Priority Data

Apr. 28, 2000 (JP) ..... P2000-134250

(51) Int. Cl.[7] ..... B24B 49/00

(52) U.S. Cl. ..... 451/8; 451/6; 451/9; 451/10; 451/11; 451/42; 451/78; 451/240; 451/255; 451/256; 451/277

(58) Field of Search ..... 451/6, 8, 9, 10, 451/11, 42, 78, 240, 255, 256, 277

(56) References Cited

U.S. PATENT DOCUMENTS

| | | | | |
|---|---|---|---|---|
| 3,645,632 A | * | 2/1972 | Schmidt et al. | 356/165 |
| 3,858,982 A | * | 1/1975 | Meckler | 356/127 |
| 4,737,918 A | | 4/1988 | Langlois et al. | |
| 4,798,459 A | | 1/1989 | Joncour | |
| 5,155,940 A | | 10/1992 | Suzuki | |
| 5,716,256 A | | 2/1998 | Mizuno et al. | |
| RE35,898 E | | 9/1998 | Shibata et al. | |

FOREIGN PATENT DOCUMENTS

| | | |
|---|---|---|
| DE | 38 29 488 A1 | 3/1990 |
| EP | 0 363 281 A2 | 4/1990 |
| EP | 0 409 760 A1 | 1/1991 |
| EP | 0 753 781 A2 | 1/1997 |
| EP | 0 876 874 A2 | 11/1998 |
| EP | 0 933 163 A1 | 8/1999 |
| EP | 1 080 835 A2 | 3/2001 |
| JP | 3-113415 | 5/1991 |
| JP | 2786848 | 5/1998 |

* cited by examiner

*Primary Examiner*—Joseph J. Hail, III
*Assistant Examiner*—Shantese McDonald
(74) *Attorney, Agent, or Firm*—Sughrue Mion, PLLC

(57) ABSTRACT

A cup attaching apparatus for attaching a cup for eyeglass lens processing to a subject lens to be processed, includes: an imaging optical system, which obtains an image of the lens by illuminating the lens with rays of light shaped to be larger in diameter than the lens; a display; a display control unit, which displays, on the display, the obtained lens image and an alignment mark superimposed on the obtained lens image, the alignment mark having substantially the same contour as a small lens portion of a bifocal lens; a first input unit, which inputs an amount of offset of the alignment mark with respect to a cup attachment center; and a second input unit, which inputs layout data for layout of the lens with respect to a target lens shape, wherein the display control unit determines a display position of the alignment mark based on the inputted offset amount and layout data, and displays the alignment mark at the determined display position on the display.

15 Claims, 8 Drawing Sheets

MENU
SELECT
TRACE
MEMORY
CREAR
S.R
POLISH
FRAME
TYPE
LENS
BLOCK
JOB
FPD
PD
U/D
AXIS
R/L
END
CE
7
8
9
4
5
6
1
2
3
0
.
+
−
2
3
3a
3b
3c
3i
3j
4
4a
4f
4g
4h
4i
4k
17a
17b
30
31
32
34
35
36
37
38
38a
38b
38c
38d
38e

CUP ATTACHING APPARATUS

BACKGROUND OF THE INVENTION

The present invention relates to a cup attaching apparatus for attaching a cup (a processing jig such as a suction cup, a leap cup which is attached through a pressure sensitive adhesive sheet, or the like) to a lens to be processed (subject lens), which cup is used at the time of processing a peripheral edge of an eyeglass lens.

A cup attaching apparatus of this type is designed such that a scale plate provided with a scale as well as a subject lens are illuminated, an image of the scale and an image of a mark point provided on the subject lens by a lens meter or the like are formed on a screen, and the scale image and mark point image are observed so as to effect alignment for attaching the cup.

In the case of a bifocal lens, an image of its small lens portion is formed on the screen, while, in the case of a progressive multifocal lens, an image of a layout mark or a hidden mark (marked in advance) printed on the lens surface is formed on the screen, and the alignment is effected on the basis of the image of the small lens portion or the mark and the image of the scale.

However, the kinds of lenses are diverse, and the cup attaching position for a bifocal lens and a progressive multifocal lens, in particular, differ depending on the lenses, it has not been easy to attach the cup to the lens with high accuracy by the alignment using the scale plate.

SUMMARY OF THE INVENTION

In view of the problems of the above-described related art, it is an object of the present invention to provide a cup attaching apparatus which makes it possible to effect the cup attachment with high accuracy and with ease.

To achieve the above-noted object, the present invention is characterized by having the following features.

(1) A cup attaching apparatus for attaching a cup for eyeglass lens processing to a subject lens to be processed, comprising:

an imaging optical system, which obtains an image of the lens by illuminating the lens with rays of light shaped to be larger in diameter than the lens;

a display;

a display control unit, which displays, on the display, the obtained lens image and an alignment mark superimposed on the obtained lens image, the alignment mark having substantially the same contour as a small lens portion of a bifocal lens;

a first input unit, which inputs an amount of offset of the alignment mark with respect to a cup attachment center; and a second input unit, which inputs layout data for layout of the lens with respect to a target lens shape, wherein the display control unit determines a display position of the alignment mark based on the inputted offset amount and layout data, and displays the alignment mark at the determined display position on the display.

(2) The cup attaching apparatus according to (1), wherein the imaging optical system includes an illuminating light source, an optical element shaping the light from the light source, a screen plate on which the lens image is formed, and an imaging element obtaining the lens image thus formed.

(3) The cup attaching apparatus according to (1), wherein the display control unit displays, on the display, at least one of a reference mark indicative of the cup attachment center, and a cup mark indicative of a contour of the cup.

(4) The cup attaching apparatus according to (1), wherein the display control unit displays, on the display, a plurality of horizontally extending line marks based on the cup attachment center or the alignment mark.

(5) The cup attaching apparatus according to (1), wherein the display control unit displays, on the display, a plurality of vertically extending line marks based on the alignment mark.

(6) A cup attaching apparatus for attaching a cup for eyeglass lens processing to a subject lens to be processed, comprising:

an imaging optical system, which obtains an image of the lens by illuminating the lens with rays of light shaped to be larger in diameter than the lens;

a display;

a display control unit, which displays, on the display, the obtained lens image and an alignment mark of a progressive multifocal lens, superimposed on the obtained lens image;

a first input unit, which inputs an amount of offset of a far-use eyepoint with respect to a hidden mark of the progressive multifocal lens; and a second input unit, which inputs layout data for layout of the lens with respect to a target lens shape, wherein the display control unit determines a display position of the alignment mark based on the inputted offset amount and layout data, and displays the alignment mark at the determined display position on the display.

(7) The cup attaching apparatus according to (6), wherein the imaging optical system includes an illuminating light source, an optical element shaping the light from the light source, a screen plate on which the lens image is formed, and an imaging element obtaining the lens image thus formed.

(8) The cup attaching apparatus according to (6), wherein the display control unit displays, on the display, at least one of a reference mark indicative of a cup attachment center, and a cup mark indicative of a contour of the cup.

(9) The cup attaching apparatus according to (6), wherein the display control unit displays, on the display, a plurality of horizontally extending line marks as the alignment mark based on a cup attachment center.

(10) The cup attaching apparatus according to (6), wherein the display control unit displays, on the display, a plurality of vertically extending line marks based on a cup attachment center or the alignment mark.

(11) A cup attaching apparatus for attaching a cup for eyeglass lens processing to a subject lens to be processed, comprising:

an imaging optical system, which obtains an image of the lens by illuminating the lens with rays of light shaped to be larger in diameter than the lens;

a display;

a display control unit, which displays, on the display, the obtained lens image and an alignment mark of a progressive multifocal lens, superimposed on the obtained lens image, the alignment mark including a plurality of horizontally extending line marks and/or a plurality of vertically extending line marks;

a first input unit, which inputs a distance of the plurality of line marks of the alignment mark; and a second input unit, which inputs layout data for layout of the lens with respect to a target lens shape, wherein the display control unit determines a display position of the alignment mark based on the inputted distance and layout data, and displays the alignment mark at the determined display position on the display.

(12) The cup attaching apparatus according to (11), wherein the imaging optical system includes an illuminating light source, an optical element shaping the light from the light source, a screen plate on which the lens image is formed, and an imaging element obtaining the lens image thus formed.

(13) The cup attaching apparatus according to (11), wherein the display control unit displays, on the display, at least one of a reference mark indicative of a cup attachment center, and a cup mark indicative of a contour of the cup.

(14) The cup attaching apparatus according to (11), wherein the display control unit displays, on the display, the plurality of horizontally extending line marks based on a cup attachment center.

(15) The cup attaching apparatus according to (11), wherein the display control unit displays, on the display, the plurality of vertically extending line marks based on a cup attachment center or the plurality of horizontally extending line marks.

The present disclosure relates to the subject matter contained in Japanese patent application No. 2000-134250 (filed on Apr. 28, 2000), which is incorporated herein by reference in its entirety.

DESCRIPTION OF THE PREFERRED EMBODIMENTS

Figure 1:
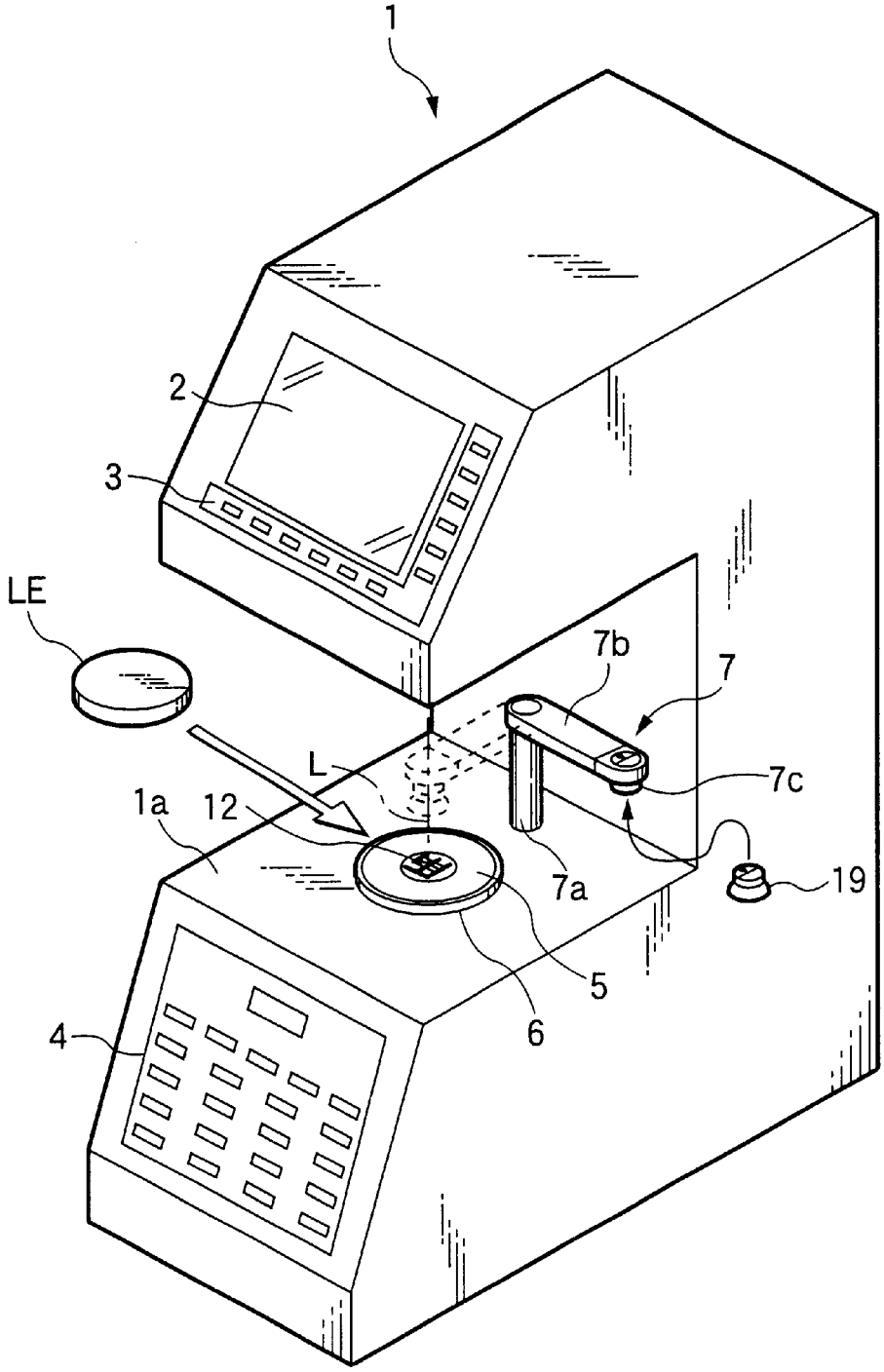
FIG. 1 is an external view of a cup attaching apparatus in accordance with an embodiment of the invention.
Figure 2:
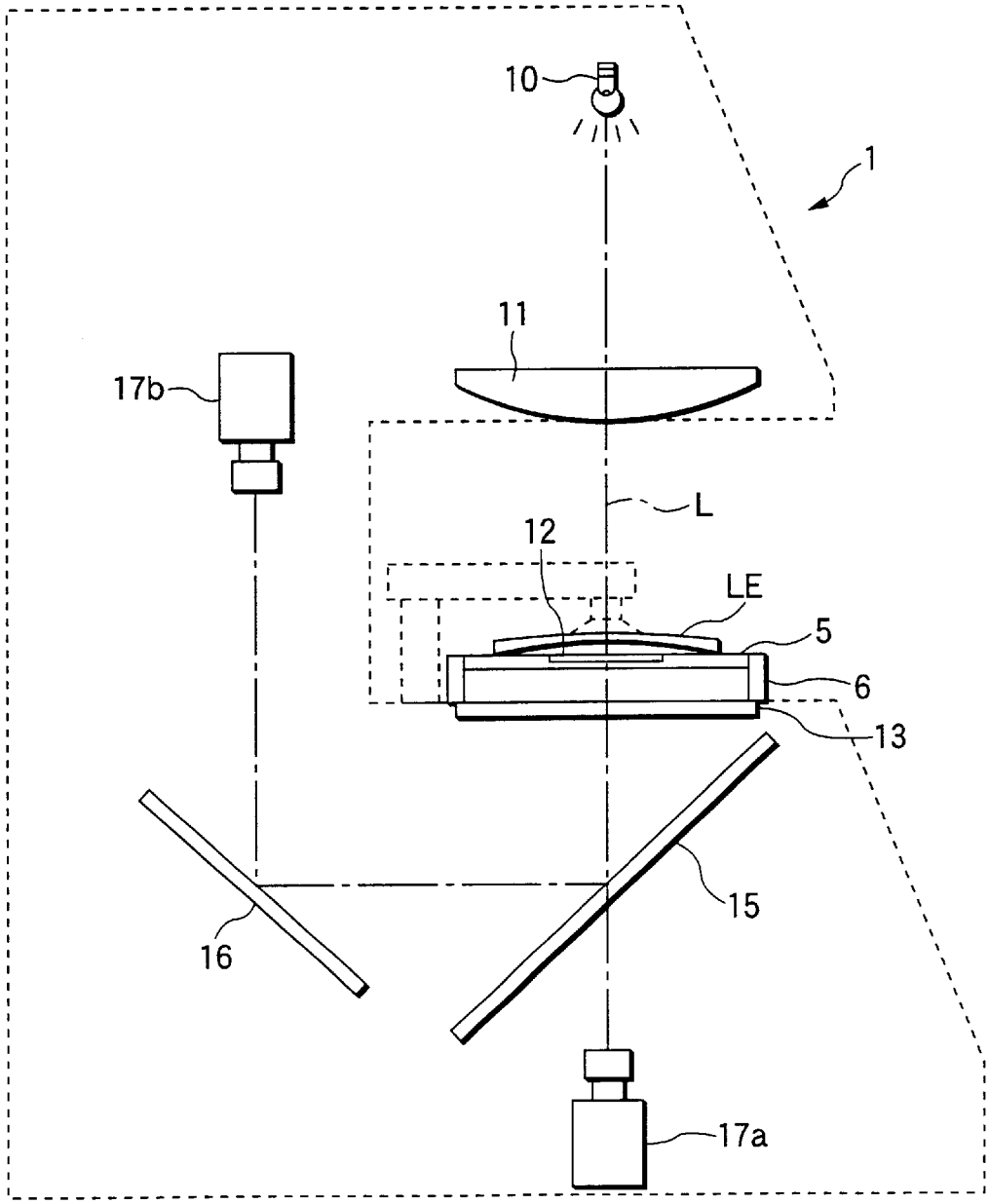
FIG. 2 is a schematic diagram of an optical system of the apparatus.

Referring now to the drawings, a description will be given of a cup attaching apparatus which constitutes an embodiment of the invention. FIG. 1 is an external view of the apparatus, and FIG. 2 is a schematic diagram of an optical system provided in the apparatus. Reference numeral 1 denotes an apparatus main body having substantially U-shaped side surfaces, and an illuminating optical system and an imaging optical system shown in FIG. 2 are disposed therein. A color monitor 2 such as a liquid-crystal display and an upper switch panel 3 are provided on an upper front surface of the main body 1, and a lower switch panel 4 is provided on a lower front surface. Displayed on the monitor 2 are an image of a subject lens LE which is imaged by a second CCD camera 17*b,* various marks for alignment, a layout screen (including input items for layout), and the like (described later).

Figure 4:
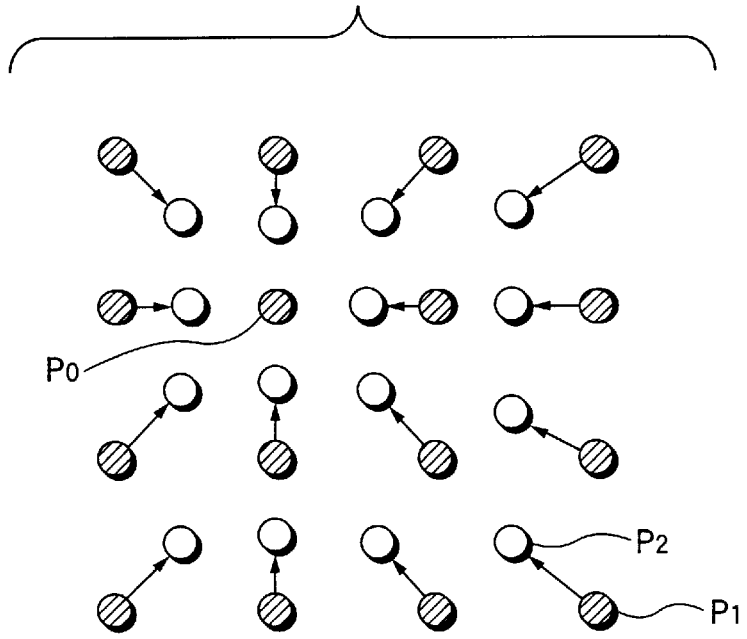
FIG. 4 is a diagram explaining a method of detecting the position of the optical center of the lens from a dot index image.

Numeral 5 denotes a circular lens table of transparent acrylic material, which is set on a base 1*a* of the main body 1 by a table support portion 6. An index portion 12 on which a prescribed pattern is provided is formed on a center of the table 5. Provided on the index portion 12 in this embodiment are a plurality of dot indexes arranged into a grid shape, which are formed by etching an upper surface of the table 5. The dot indexes, each having 0.3 mm in diameter are provided at 0.3 mm pitches in an square area of 20 mm×20 mm about the reference axis L that is a center for the cup attachment (see FIG. 4). The index portion 12 may be disposed on the illumination light source side with respect to the lens LE.

Numeral 7 denotes a lens attaching portion for attaching a cup 19, i.e., a processing jig, to the lens LE. The cup attaching portion 7 includes a shaft 7*a* which is rotated by a motor 31 and moved vertically by a motor 32, and an arm 7*b* fixed to the shaft 7*a*. The motors 31 and 32 are provided inside the main body 1. An attaching portion 7*c* for fitting a proximal portion of the cup 19 is provided on the underside of a distal end of the arm 7*b*. The cup 19 is attached in a predetermined direction in accordance with a positioning mark provided on an upper surface of the arm 7*b*. When the arm 7*b* is rotated to the position indicated by the dotted lines in FIG. 1 in conjunction with the rotation of the shaft 7*a,* the center of the cup 19 arrives at the reference axis L. It should be noted that a mechanism for moving the cup attaching portion 7 may be so arranged that the shaft 7*a* is moved horizontally (linearly) in stead of being rotated used in this embodiment. Further, the shaft 7*a* may project not from the lower side of the main body 1, but from the upper side thereof.

In FIG. 2, numeral 10 denotes an illuminating light source, and 11 denotes a collimator lens. An optical axis of the collimator lens 11 is substantially coincident with the reference axis L, and an illumination light source 10 is located at or around a focal point of the lens 11 in the rear side. The illuminating light from the light source 10 is converted into substantially parallel rays of light having a larger diameter than that of the lens LE by means of the collimator lens 11, and is then projected onto the lens LE placed on the table 5.

A screen plate 13 made of semi-transparent or translucent material, such as frosted or grounded glass, is disposed below the table 5. The light is transmitted through the lens LE and illuminates the index portion 12 on the table 5, so that an overall image of the lens LE and dot index images (i.e. images of dot indexes) subjected to the prismatic action of the lens LE are projected onto the screen plate 13. A half mirror 15 is disposed below the screen plate 13, and a first CCD camera 17*a* is provided on the reference axis L in the direction of its transmittance. This first camera 17*a* is disposed so as to be able to image in enlarged form only a central region with the reference axis L set as a center for the cup attachment so that the dot index images formed on the screen plate 13 can be detected. Meanwhile, a mirror 16 and a second CCD camera 17*b* for imaging an image reflected by the mirror 16 are disposed in the reflecting direction of the half mirror 15. This second camera 17*b* is disposed so as to be able to image the substantially entire screen plate 13 so that the overall image of the lens LE projected onto the screen plate 13 can be obtained.

Figure 3:
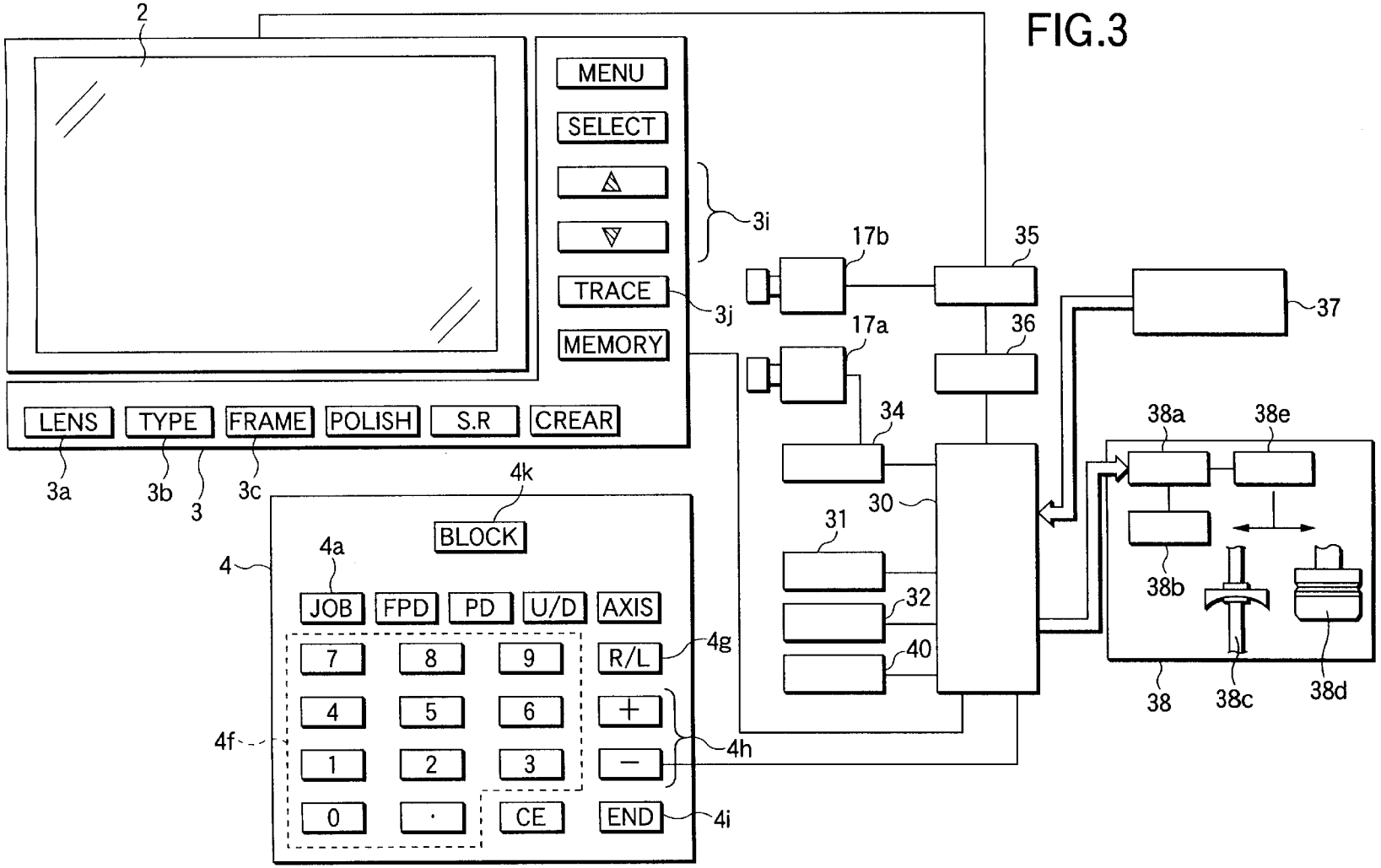
FIG. 3 is a block diagram of a control system of the apparatus.

FIG. 3 is a block diagram illustrating a controlling system of the apparatus. An image signal from the first camera 17*a* is inputted to an image processing unit 34. The processing unit 34 effects image processing to detect the position of each dot index image, and inputs the detected signal to a control unit 30. On the basis of the detected signal thus inputted, the control unit 30 determines the position of the optical center of the lens LE and the direction (angle) of the cylinder axis (astigmatism axis) (which will be described later). Meanwhile, an image signal from the second camera 17*b* is inputted to an image synthesizing circuit 35, and the circuit 35 combines the image of the lens LE with characters, marks and so on generated by a display circuit 36 connected to the control unit 30, and displays the same on the monitor 2.

Furthermore, also connected to the control unit 30 are the motor 31 for rotating the shaft 7*a,* the motor 32 for vertically moving the shaft 7*a,* a memory 40 for storing the inputted data and the like, the switch panels 3 and 4, a target lens shape measuring device 37 for measuring a target lens shape of an eyeglasses frame, a template, a dummy lens or the like, and a lens processing apparatus 38 for grinding the lens LE.

A description will be given of a method of determining the position of the optical center of the lens LE and the direction of the cylinder axis on the basis of the image obtained by the first camera 17*a.*

When the lens LE is not mounted on the table 5, the dot indexes on the index portion 12 are illuminated by the parallel rays of light, so that the dot index images are projected as they are onto the screen plate 13. On the basis of the image picked up by the first camera 17*a* with the lens LE not mounted, the processing unit 34 determines the coordinate positions of the dot index images, and stores the same in advance. When the lens LE is mounted on the table 5, the position of the dot index image located immediately below the vicinity of the optical center of the lens LE remains the same irrespective of the presence or absence of the lens LE, but the coordinate positions of the dot index images located at portions which are not at the optical center are changed due to the prismatic action of the lens LE. Accordingly, to detect the position of the optical center, a change in the coordinate position of each dot index image with the lens LE mounted with respect to the coordinate position of each dot index image with the lens LE not mounted is examined, and a center position where the dot index images diverge from or converge toward is determined. Namely, the center position of this divergence or convergence can be detected as the position of the optical center. In the example shown in FIG. 4, for instance, when the lens LE is mounted, dot index images $P_1$ with the lens LE not mounted converge (move) with a dot index image $P_0$ as the center to become dot index images $P_2$. Accordingly, the coordinate position of the dot index image $P_0$ can be detected as the position of the optical center. Even if the optical center is located between dot indexes, it suffices if the optical center is determined by interpolating the center of movement on the basis of the moving directions of the dot index images and the amounts of their movement.

When the lens LE has cylindrical refractive power (astigmatic power), the dot index images move in a direction toward (or away from) a generating line of the lens LE. Hence, the direction of the cylinder axis can be similarly detected by examining in which direction the dot index images are moving with respect to the coordinate positions of the dot index images with the lens LE not mounted.

Next, a description will be given of the operation of the apparatus having the above-described configuration. Hereafter, a description will be given of cases where the types of the lenses LE to be processed are a monofocal lens, a bifocal lens, a progressive multifocal lens, respectively.

Monofocal Lens

First, the target lens shape of the eyeglasses frame into which the lens LE is fitted (or the target lens shape of the template or the dummy lens) is measured in advance by the measuring device 37 connected to the main body 1. Subsequently, if a TRACE key 3*j* is pressed, data on the target lens shape (traced outline) is inputted. The inputted target lens shape (traced outline) data is stored in the memory 40, and an target lens shape (traced outline) FIG. 20 based on the inputted target lens shape (traced outline) data is displayed on the monitor 2 (See FIG. 5).

The operator presses a JOB switch 4*a,* inputs numerical value of JOB number using a ten key 4*f,* and then fix the JOB number using an ENT key 4*i.* Subsequently, the operator selects the right or left of the lens LE to be subjected to the cup attachment using a R/L key 4*g,* and inputs frame-fitting conditions, including the layout data of the lens LE with respect to the target lens shape (traced outline) and the type of the lens LE, by operating keys on the switch panels 3 and 4. The type of the lens (i.e., a monofocal, biforcal or progressive multifocal lens) is selected by a TYPE key 3*b.*

Figure 5:
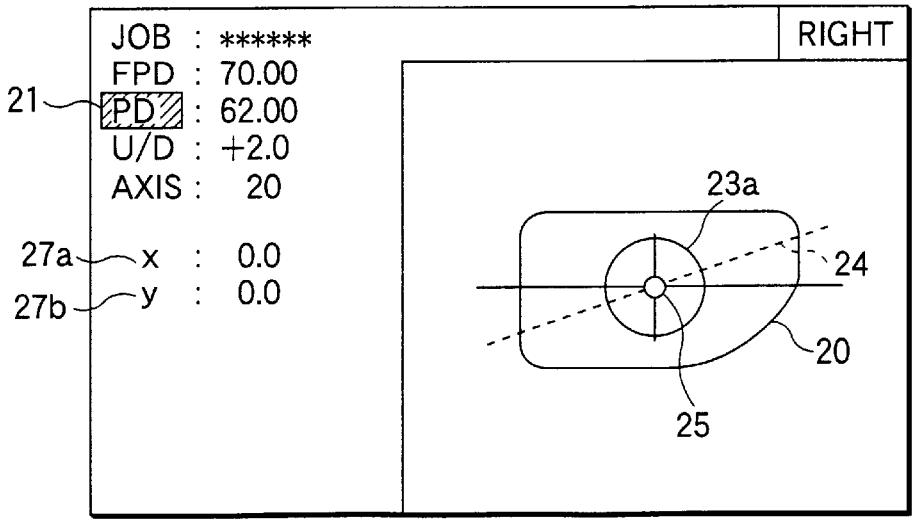
FIG. 5 is a diagram of an example of the screen of a monitor in a monofocal lens mode.

In the case of the monofocal lens mode shown in FIG. 5, since input items for the layout of the lens LE are displayed on the left-hand side of the screen of the monitor 2, a highlighted cursor 21 is moved by a cursor moving key 3*i* to select items to be inputted. The values of the input items can be changed by a "+" "−" key 4*h* or a ten-key 4*f,* and layout data including FPD (the distance between geometric centers of both target lens shapes), PD (pupillary distance), and U/D (the height of the optical center with respect to the geometric center of each target lens shape) are inputted. In addition, when the lens LE has cylindrical refractive power (astigmatic power), the cursor 21 is moved to the item AXIS, and the cylinder axis angle (direction) in the prescription is inputted in advance (or the angle of the cylinder (astigmatic) axis is set to 180° or 90°).

Incidentally, at the time of inputting data, the layout data may be transferred to the lens processing apparatus (lens edger) 38, and the type of the lens LE (such as plastic or glass) and the type of the eyeglasses frame (such as metal or cell) may be inputted in advance by a LENS key 3*a,* a FRAME key 3*c,* and the like for convenience sake, so that processing can be performed smoothly by using the layout data. In a case where the shape of the eyeglass frame has been measured, the frame shape data (three-dimensional data) is transferred and inputted to the lens processing apparatus (lens edger) 38.

In addition to the target lens shape (traced outline) FIG. 20, a cup FIG. 23*a* indicating the shape of the cup 19 to be attached to the lens LE is displayed in red color on the screen of the monitor 2 (see FIG. 5) by using as the center the position on the screen corresponding to the reference axis L which is the center of cup attachment. The data on the shape of the cup 19 for displaying the cup FIG. 23*a* is stored in advance in the memory 40. In a state prior to the mounting of the lens LE, the target lens shape (traced outline) FIG. 20 is displayed in such a state that the layout optical center (eyepoint position) is aligned with the center of the cup FIG. 23*a*. In addition, if the data on the angle of the cylinder (astigmatic) axis is inputted, an AXIS mark 24 inclined in the direction of that angle is displayed in red color.

When necessary data have been inputted, the operator places the lens LE on the table 5, and performs alignment for attaching the cup 19. If the center of the lens LE is made to be located in the vicinity of the center of the table 5 (such that the position of the optical center of the lens LE is located within the index portion 12), an image of the lens LE and images of the dot indexes on the index portion 12 are formed on the screen plate 13. The second camera 17*b* picks up an entire image of the lens LE, and its picked-up image L3' is displayed on the screen of the monitor 2 (see FIG. 6). The dot index images formed on the screen plate 13 are picked up by the first camera 17*a*. The image signal is inputted to the processing unit 34, and the control unit 30 executes the aforementioned method to continuously obtain information on the displacement (offset) of the position of the optical center from the reference axis L and information on the direction of the cylinder axis on the basis of information on the coordinate positions of dot index images detected by the image processing unit 34.

Figure 6:
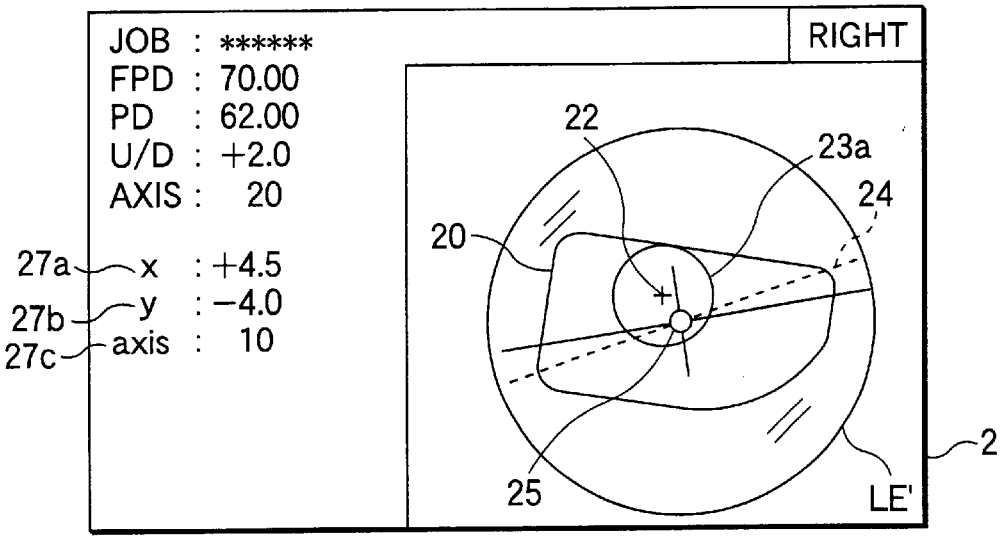
FIG. 6 is a diagram of another example of the screen of the monitor in the monofocal lens mode.

After these items of information are obtained, a cross mark 25 indicating the position of the optical center of the lens LE is displayed in white color by the display circuit 36 which is controlled by the control unit 30, as shown in FIG. 6. This cross mark 25 is displayed such that the center of a circle "O" depicted in the center conforms to the detected position of the optical center of the lens LE, and such that the long axis of the cross mark 25 is inclined to conform to the information on the direction of the cylinder axis detected. Further, the red ASIX mark 24 indicating the angle (direction) of the cylinder (astigmatic) axis inputted is displayed with the center of the cross mark 25 (the position of the optical center of the lens LE) as a reference.

In addition, the target lens shape (traced outline) FIG. 20 is displayed such that the position of the layout optical center (eyepoint position) is aligned with the detected position of the optical center of the lens LE, and such that the inputted angle (direction) of the cylinder (astigmatic) axis conforms to the detected direction of the cylinder axis of the lens LE. Further, since this target lens shape (traced outline) FIG. 20 is displayed by being superposed on the lens image L3', by observing the two images at this stage the operator is able to instantly determine whether or not the lens diameter is insufficient for processing.

The alignment operation for attaching the cup 19 at the position of the optical center of the lens LE is performed as follows. Since a reference mark 22 serving as a target for positioning is displayed in red color at the center of the cup FIG. 23*a* on the screen, the operator moves the lens LE so that the center of the reference mark 22 and the center of the cross mark 25 are aligned, thereby effecting the alignment of the position of the optical center of the lens LE with respect to the reference axis L. As for the alignment of the direction of the cylinder axis, the lens LE is rotated so that the long axis of the cross mark 25 conforms to the direction of the AXIS mark 24. At this time, since the AXIS mark 24 serving as a target for alignment is displayed with the detected position of the optical center of the lens LE as a reference, the alignment of the direction of the cylinder axis can be concurrently effected while performing the alignment of the position of the optical center. In addition, since the alignment of the position of the optical center can be effected after substantially completing the alignment of the direction of the cylinder axis, the degree of offset of the center accompanying the rotational movement of the lens LE is reduced, so that the efficiency in the alignment operation can be achieved.

It should be noted that information on the displacement (offset) of the position of the optical center of the lens LE with respect to the reference axis L is displayed in display items 27*a* and 27*b* on the left-hand side of the monitor 2 as numerical values of distance (unit: mm) by x and y. Further, the detected angle of the cylinder axis is numerically displayed in a display item 27*c*. Through these displays as well, the operator is able to know position information necessary for alignment. In addition, since the amount of fine alignment adjustment can be recognized by the numerical displays, the alignment operation can be performed more simply.

Figure 7:
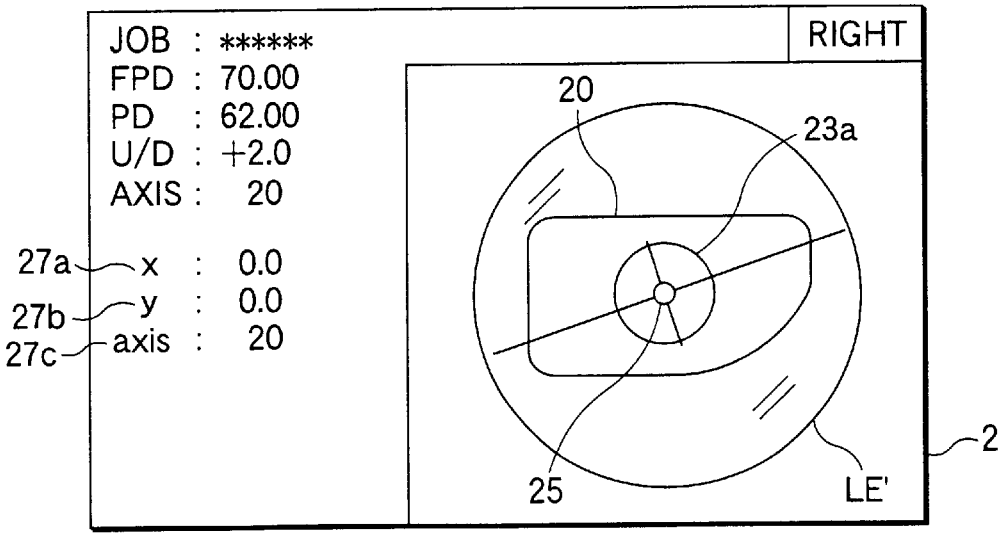
FIG. 7 is a diagram of still another example of the screen of the monitor in the monofocal lens mode.

When the detected direction of the cylinder axis with respect to the inputted angle (direction) of the cylinder (astigmatic) axis has fallen within a predetermined allowable range, as shown in FIG. 7, the white cross mark 25 is superposed on the AXIS mark 24, and the display of the red AXIS mark 24 disappears. Meanwhile, when the detected position of the optical center with respect to the position of the reference axis L has fallen within a predetermined allowable range, the display of the reference mark 22 disappears such that the reference mark 22 is hidden by the circle "O" depicted in the center of the cross mark 25. Then, upon completion of the alignment of both the direction of the cylinder axis and the position of the optical center, the color of the cup FIG. 23*a* changes from red to blue. Through the change of the mark for alignment and the change of the color of the cup FIG. 23*a,* the operator is able to ascertain the completion of alignment. In addition, in the example shown in FIG. 7, since the cup FIG. 23*a* is accommodated within the target lens shape (tranced outline) FIG. 20, it is possible to confirm that no processing interference will occur at the time of processing by the lens processing apparatus (lens edger) 38.

Upon completion of the alignment of the position of the optical center of the lens LE and the direction of the cylinder axis, the operator presses a BLOCK key 4*k* for instructing the cup attachment. The control unit 30 drives the motor 31 to rotate the shaft 7*a* so as to allow the cup 19 to arrive at the reference axis L, then drives the motor 32 to lower the cup 19 and allows the lens LE to be fixed by the cup 19.

Although a description has been given of the case where the cup 19 is attached to the position of the optical center of the lens LE, in this apparatus, the cup 19 may be attached to an arbitrary position, and information on that attached position may be used as correction information for coordinate transformation at the time of processing by the lens processing apparatus (lens edger) 38. As for the alignment of the lens LE in this case, if the lens LE is moved so that the cup FIG. 23*a* is accommodated within the target lens shape (traced outline) FIG. 20 as shown in FIG. 6, it is possible to prevent the cup 19 from causing processing interference, so that the cup attachment is possible in this state.

As for the alignment in the direction of the cylinder axis as well, information on offset between the inputted angle (direction) of the cylinder (astigmatic) axis and the detected direction of the cylinder axis can be obtained, and this offset information can be corrected on the lens processing apparatus (lens edger) 38 side, so that accurate alignment is unnecessary. Since the target lens shape (traced outline) FIG. 20 is displayed in correspondence with the detected angle (direction) of the cylinder axis (i.e., it is displayed by being inclined in correspondence with the amount of offset of the angle of the cylinder axis), if confirmation is made that the cup FIG. 23*a* can be accommodated within the target lens shape (traced outline) FIG. 20, it is possible to attach the cup 19 at the position where processing interference can be avoided.

It should be noted that, at the time of performing the cup attachment, the JOB number is inputted in advance by operating the key 4*a* and the key 4*f*, so that the target lens shape (traced outline) data, the layout data, the information on the displacement (offset) of the position of the optical center, the information on the displacement (offset) of the direction of the cylinder axis, and the like which are stored in the memory 40 can be managed by the JOB number.

Bifocal Lens

Figure 8:
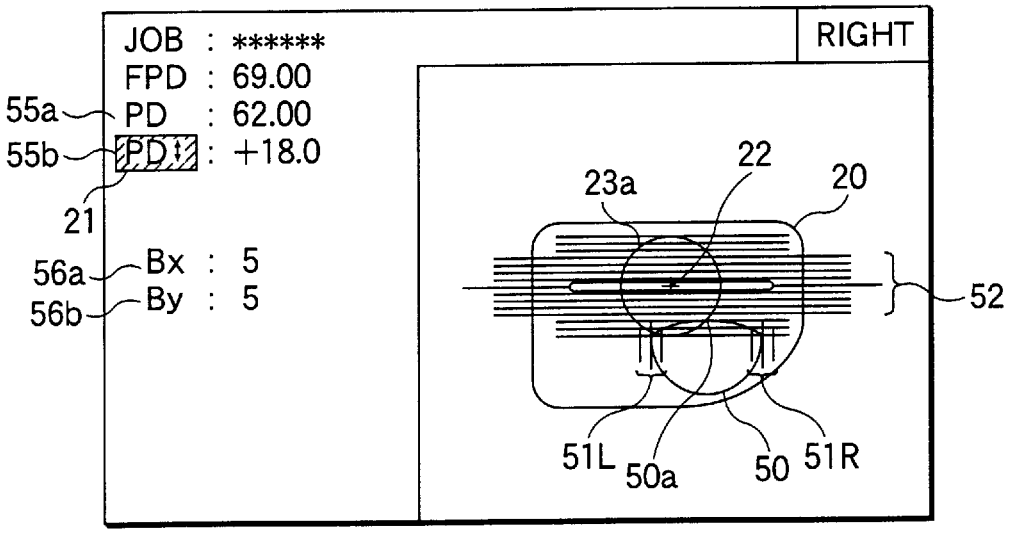
FIG. 8 is a diagram of an example of the screen of the monitor in a bifocal lens mode.

After the target lens shape (traced outline) data is inputted in the same way as described above, a bifocal lens mode is selected by the key 3*b*. As shown in FIG. 8, a small lens mark 50, which simulates the small lens portion of the bifocal lens, is displayed on the screen of the monitor 2 at a position which is offset by a preset amount of deviation with respect to the reference mark 22 indicating the center of cup attachment. Further, three vertical line marks 51L, 51R at 2 mm intervals are displayed at each of left and right ends of the small lens mark 50. An upper boundary center 50*a* of the small lens mark 50 serves as a reference for aligning the small lens portion of the lens LE, while the vertical line marks 51L and 51R serve as guides for the left-right distribution in alignment. Further, a plurality of horizontal line marks 52 are displayed at 1-mm pitch intervals by using the cup attachment center (reference mark 22) as a reference, and these horizontal line marks 52 serve as guides for horizontally aligning the small lens portion. It should be noted that the horizontal line marks 52 may be displayed by using the small lens mark 50 as a reference.

Input items for the layout of the lens LE are displayed on the left-hand side of the screen of the monitor 2. The pupillary distance for the near use is entered in an item 55*a*, while the distance from the upper boundary center of the small lens portion to the bottom of the target lens shape (traced outline) directly below the upper boundary center is entered in an item 55*b*. As a result, the display position of the target lens shape (traced outline) FIG. 20 is determined, thereby completing the layout of the lens LE with respect to the target lens shape (traced outline) data.

It should be noted that FIG. 8 is an example in which the right lens has been selected by the key 4*g*. In a case where the left lens is selected, the display positions of the small lens mark 50 and the vertical line marks 51L and 51R are changed to bilaterally inverted positions about the reference mark 22.

Figure 9:
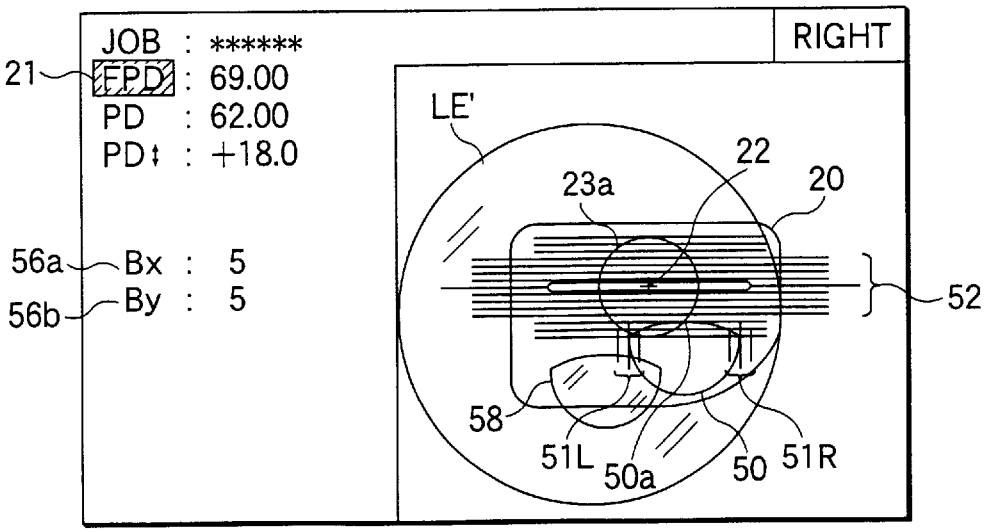
FIG. 9 is a diagram of another example of the screen of the monitor in the bifocal lens mode.

The positioning of the bifocal lens is carried out as follows. If the lens (bifocal lens) LE is placed on the table 5, a small lens image of the lens LE illuminated by parallel rays of light is formed clearly on the screen plate 13. This image is picked up by the second camera 17*b*, and the lens image LE' and a small lens image 58 are displayed on the monitor 2, as shown in FIG. 9. The operator moves the lens LE such that the upper boundary center of the small lens image 58 is superposed on the upper boundary center 50*a* of the small lens mark 50. Although the size of the small lens portion differs depending on the kind of lens, the alignment of the upper boundary center can be effected easily by uniformly distributing the left and right portions of the small lens image 58 by using as guides the vertical line marks 51L and 51R displayed symmetrically on the left- and right-hand sides of the small lens mark 50. In addition, the alignment is made in conformity with the horizontal line marks 52 so that the horizontal axis of the small lens image 58 will not be tilted.

Here, in the case of the bifocal lens, the position of attachment of the cup 19 with respect to the small lens portion is not fixed, and differs depending on the policy of a processor (eyeglasses shop) or a lens manufacturer. In order that easy alignment in accordance wit the small lens mark 50 displayed on the above-described monitor 2 is realized even in such a case, this apparatus is designed so that the display position (layout) of the small lens mark 50 can be changed arbitrarily.

Figure 10:
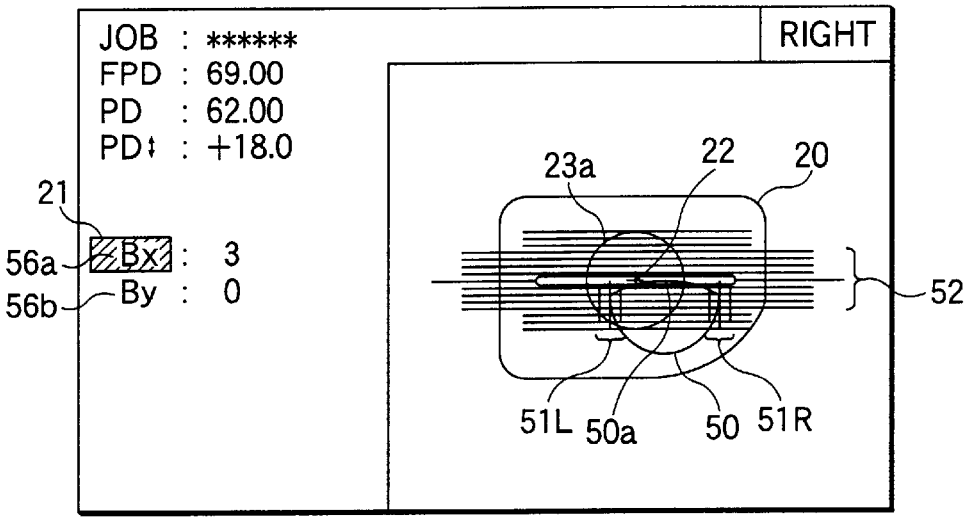
FIG. 10 is a diagram of still another example of the screen of the monitor in the bifocal lens mode.

In the case where the position of attachment of the cup 19 with respect to the small lens portion of the bifocal lens is to be changed, the display position of the small lens mark 50 can be changed by changing values of a BX item 56*a* and a BY item 56*b*. The item 56*a* indicates the distance (mm) of offsetting the cup attaching position upwardly from the upper boundary center of the small lens, while the item 56*b* indicates the distance (mm) of offsetting the cup attaching position outwardly from the upper boundary center of the small lens. Each of the values of the items 56*a* and 56*b*, after the cursor 21 is located thereto using the key 3*i*, is changed to a desired value using the keypad 4*f*, and then fixed and entered by the key 4*i*. As a result, the display position of the small lens mark 50 in the horizontal and vertical directions with respect to the reference mark 22 on the monitor 2 is changed. In addition, the display positions of the vertical line marks 51L and 51R are moved in linking with the change of the display position of the small lens mark 50 (see FIG. 10). Furthermore, in the case where the horizontal line marks 52 are displayed using the small lens mark 50 as a reference, the display positions of the horizontal line marks 52 are also moved. The display on the monitor 2 is controlled via the display circuit 36 by the control unit 30. The lens LE is aligned while confirming the position of the small lens image 58 with respect to the small lens mark 50, the vertical line marks 51L and 51R, and the horizontal line marks 52 in the same way as described above.

Upon completion of the alignment in the above-described manner, confirmation is made as to whether or not processing is possible with respect to the lens diameter through comparison between the lens image L3' and the target lens shape (traced outline) FIG. 20, and confirmation is made as to the interference in processing through comparison between the cup FIG. 23*a* and the target lens shape (traced outline) FIG. 20. Then, the key 4*k* is pressed to operate the cup attaching portion 7 so as to attach the cup 19 to the lens LE. Furthermore, at the same time as the cup attachment, the processing conditions, the layout data (including the values of the BX item 56*a* and the BY item 56*b*), and the target lens shape (traced outline) data, which have been set, are also stored in the memory 40 in correspondence with the JOB number.

In the case where the main body 1 and the lens processing apparatus (lens edger) 38 are connected in such a manner as to be capable of effecting data communication, it is possible to transfer and input the data stored in the memory 40 to the processing apparatus 38 side by designating the JOB number. As the processing apparatus 38, it is possible to use, for example, one disclosed in commonly assigned U.S. Pat. No. 5,716,256. The processing apparatus chucks the lens LE using two lens rotating shafts 38*c* and operates a moving mechanism 38*e*, which changes the axis-to-axis distance between the abrasive wheel rotating shaft of an abrasive wheel 38*d* and the lens rotating shafts 38*c,* thereby processing the lens LE based on the inputted data. When the cup 19 is attached in the bifocal lens mode, since data on the positional relationship between the cup attachment center and the small lens portion (the aforementioned values of the BX item 56*a* and the BY item 56*b*) are also inputted, the processing data are calculated on the processing apparatus 38 side on the basis of these data.

Progressive Multifocal Lens

After the target lens shape (traced outline) data are inputted in the same way as described above, the progressive multifocal lens mode is selected by the key 3*b*. The following procedure is taken in a case where the cup 19 is attached to the position of the eye point for far use by using a far-use eyepoint mark and a horizontal layout mark which are printed on the progressive multifocal lens. If the lens (progressive multifocal lens) LE is placed on the table 5, an image of the far-use eyepoint mark and an image of the horizontal layout mark, together with an image of the lens LE, are formed clearly on the screen plate 13, and these images are picked up by the second camera 17*b,* and are displayed on the monitor 2.

Figure 11:
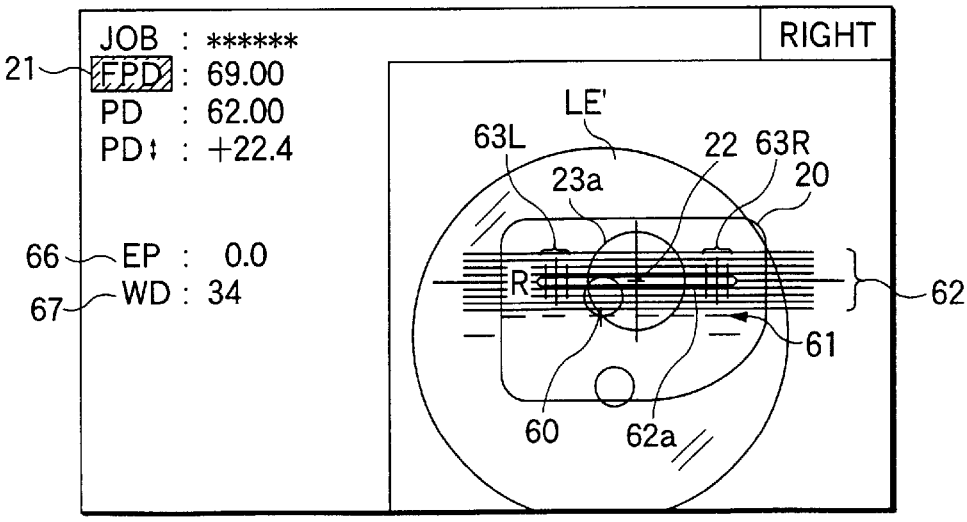
FIG. 11 is a diagram of an example of the screen of the monitor in a progressive multifocal lens mode.

FIG. 11 shows an example of the screen at this time, and the display position of the target lens shape (traced outline) FIG. 20 is determined by inputting in advance the layout data of the progressive multifocal lens in accordance with the input items being displayed on the left-hand side of the screen of the monitor 2. The operator observes a far-use eyepoint mark image 60 and a horizontal layout mark image 61, and moves the lens LE to align the far-use eyepoint mark image 60 with the reference mark 22. In addition, axis alignment can be made such that the horizontal layout mark image 61 is not tilted with respect to horizontal line marks 62, i.e., marks for alignment, which are displayed at 1-mm pitch intervals by using the cup attachment center (reference mark 22) as a reference.

The following procedure is taken in a case where the cup 19 is attached to the far-use eyepoint position by using hidden marks on the progressive multifocal lens. Since two hidden marks are generally provided on the lens surface of the progressive multifocal lens, these hidden marks are confirmed and marks are respectively applied to these hidden marks with a pen or the like in advance. In addition, the distance (EP value) from the hidden mark on the lens LE to the far-use eyepoint height is inputted in advance in an EP item 66 shown in FIG. 12 as the layout data by the key 4*f* or the like in the same way as the above-described input of the layout data. Since this EP value is predetermined in accordance with the types of the progressive multifocal lenses in a manufacturer-by-manufacturer basis, the input can be made upon confirming the predetermined EP value. By inputting the EP value, the display positions of the horizontal line marks 62 and a horizontal center frame mark 62*a* are displayed by being offset correspondingly to the input value with respect to the reference mark 22. In the example shown in FIG. 12, the display positions are offset 3.5 mm downwardly.

Figure 12:
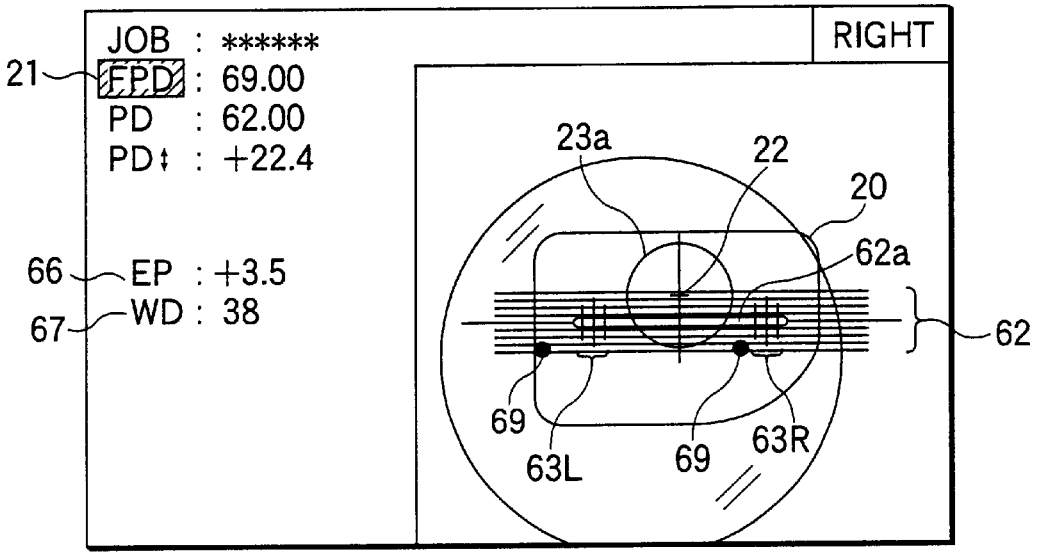
FIG. 12 is a diagram of another example of the screen of the monitor in the progressive multifocal lens mode.

If the lens (progressive multifocal lens) LE is placed on the table 5, as shown in FIG. 12, since two images 69 of the marks applied to the hidden marks are displayed on the monitor 2, the lens LE is moved such that the two mark images 69 are located within the horizontal center frame mark 62*a*. In addition, in the progressive multifocal lens mode, as the left and right alignment marks three vertical line marks 63L at 2-mm intervals and three vertical line marks 63R are respectively displayed bilaterally symmetrically on the left-hand side and the right-hand side with the reference mark 22 or the horizontal line mark 62 as a reference. Therefore, alignment is made by using these vertical line marks, so that the two mark images 69 become bilaterally uniform.

Here, the interval between the vertical line marks 63L and the vertical line marks 63R can be varied by the distance value (WD value) of a layout item 67. The interval between the two hidden marks provided on the progressive multifocal lens differs depending on the lens manufacturers and the types of lenses. For this reason, the interval between the vertical line marks 63L and the vertical line marks 63R (i.e. between a central one of the marks 63L and a central one of the marks 63R) is changed in advance in conformity with the interval between the two hidden marks. The change of the WD value in the item 67 can be made by inputting a desired value by the keying operation of the switch panels 3 and 4 in the same way as the other items. As a result of the change of the WD value, the display positions of the vertical marks 63L and 63R are changed, so that the confirmation of the bilaterally uniform alignment of the two mark images 69 can be facilitated. It should be noted that the interval between the adjacent lines of the horizontal line marks 62 may be made variable.

Upon completion of the alignment of the lens LE in the above-described manner, the presence or absence of the processing interference between the processing diameter and the cup 19 is confirmed, and then the key 4*k* is pressed to attach the cup 19 to the lens LE.

As described above, in accordance with the invention, the cup attachment can be effected with high accuracy and with ease.

What is claimed is:

1. A cup attaching apparatus for attaching a cup for eyeglass lens processing to a subject lens to be processed, comprising:

an imaging optical system, which obtains an image of the lens by illuminating the lens with rays of light shaped to be larger in diameter than the lens;

a display;

a display control unit, which displays, on the display, the obtained lens image and an alignment mark superimposed on the obtained lens image, the alignment mark having substantially the same contour as a small lens portion of a bifocal lens;

a first input unit, which inputs an amount of offset of the alignment mark with respect to a cup attachment center; and a second input unit, which inputs layout data for layout of the lens with respect to a target lens shape, wherein the display control unit determines a display position of the alignment mark based on the inputted offset amount and layout data, and displays the alignment mark at the determined display position on the display.

2. The cup attaching apparatus according to claim 1, wherein the imaging optical system includes an illuminating light source, an optical element shaping the light from the light source, a screen plate on which the lens image is formed, and an imaging element obtaining the lens image thus formed.

3. The cup attaching apparatus according to claim 1, wherein the display control unit displays, on the display, at least one of a reference mark indicative of the cup attachment center, and a cup mark indicative of a contour of the cup.

4. The cup attaching apparatus according to claim 1, wherein the display control unit displays, on the display, a plurality of horizontally extending line marks based on the cup attachment center or the alignment mark.

5. The cup attaching apparatus according to claim 1, wherein the display control unit displays, on the display, a plurality of vertically extending line marks based on the alignment mark.

6. A cup attaching apparatus for attaching a cup for eyeglass lens processing to a subject lens to be processed, comprising:

an imaging optical system, which obtains an image of the lens by illuminating the lens with rays of light shaped to be larger in diameter than the lens;

a display;

a display control unit, which displays, on the display, the obtained lens image and an alignment mark of a progressive multifocal lens, superimposed on the obtained lens image;

a first input unit, which inputs an amount of offset of a far-use eyepoint with respect to a hidden mark of the progressive multifocal lens; and a second input unit, which inputs layout data for layout of the lens with respect to a target lens shape, wherein the display control unit determines a display position of the alignment mark based on the inputted offset amount and layout data, and displays the alignment mark at the determined display position on the display.

7. The cup attaching apparatus according to claim 6, wherein the imaging optical system includes an illuminating light source, an optical element shaping the light from the light source, a screen plate on which the lens image is formed, and an imaging element obtaining the lens image thus formed.

8. The cup attaching apparatus according to claim 6, wherein the display control unit displays, on the display, at least one of a reference mark indicative of a cup attachment center, and a cup mark indicative of a contour of the cup.

9. The cup attaching apparatus according to claim 6, wherein the display control unit displays, on the display, a plurality of horizontally extending line marks as the alignment mark based on a cup attachment center.

10. The cup attaching apparatus according to claim 6, wherein the display control unit displays, on the display, a plurality of vertically extending line marks based on a cup attachment center or the alignment mark.

11. A cup attaching apparatus for attaching a cup for eyeglass lens processing to a subject lens to be processed, comprising:

an imaging optical system, which obtains an image of the lens by illuminating the lens with rays of light shaped to be larger in diameter than the lens;

a display;

a display control unit, which displays, on the display, the obtained lens image and an alignment mark of a progressive multifocal lens, superimposed on the obtained lens image, the alignment mark including a plurality of horizontally extending line marks and/or a plurality of vertically extending line marks;

a first input unit, which inputs a distance of the plurality of line marks of the alignment mark; and a second input unit, which inputs layout data for layout of the lens with respect to a target lens shape, wherein the display control unit determines a display position of the alignment mark based on the inputted distance and layout data, and displays the alignment mark at the determined display position on the display.

12. The cup attaching apparatus according to claim 11, wherein the imaging optical system includes an illuminating light source, an optical element shaping the light from the light source, a screen plate on which the lens image is formed, and an imaging element obtaining the lens image thus formed.

13. The cup attaching apparatus according to claim 11, wherein the display control unit displays, on the display, at least one of a reference mark indicative of a cup attachment center, and a cup mark indicative of a contour of the cup.

14. The cup attaching apparatus according to claim 11, wherein the display control unit displays, on the display, the plurality of horizontally extending line marks based on a cup attachment center.

15. The cup attaching apparatus according to claim 11, wherein the display control unit displays, on the display, the plurality of vertically extending line marks based on a cup attachment center or the plurality of horizontally extending line marks.

* * * * *